United States Patent [19]

Sutherland

[11] Patent Number: 4,657,599

[45] Date of Patent: Apr. 14, 1987

[54] PROCESS FOR IMPROVING CORROSION RESISTANCE OF ZINC OR CADMIUM PLATED METAL ARTICLES

[75] Inventor: James A. Sutherland, Toronto, Canada

[73] Assignee: Torcad Limited, Toronto, Canada

[21] Appl. No.: 789,694

[22] Filed: Oct. 21, 1985

[51] Int. Cl.[4] ..... C23C 22/14; C23C 22/82

[52] U.S. Cl. ..... 148/6.2; 427/397.7; 427/397.8

[58] Field of Search ..... 148/6.2; 427/397.7, 427/397.8

[56] References Cited

U.S. PATENT DOCUMENTS 4,462,842 7/1984 Uchiyama ..... 148/6.2

4,487,815 12/1981 Dorsett ..... 148/6.2

*Primary Examiner*—Sam Silverberg

*Attorney, Agent, or Firm*—Robert F. Delbridge; Arne I. Fors

[57] ABSTRACT

A process for improving corrosion resistance of a metal article plated with zinc or cadmium includes coating the plated article with a chromium solution to provide the article with a chromate coating having a yellow to olive-drab colour, and immersing the chromated article in a silicate solution for a sufficient time to cause the article to assume an acceptable white or grey colour and also increase its corrosion resistance.

8 Claims, No Drawings

PROCESS FOR IMPROVING CORROSION RESISTANCE OF ZINC OR CADMIUM PLATED METAL ARTICLES

This invention relates to improving the corrosion resistance of zinc or cadmium plated metal articles.

Corrosion of metal parts is potentially dangerous and/or unsightly. It has been conventional for many years to electroplate a base metal with another metal to improve corrosion resistance. For example, in some industries, it has been conventional to plate metal articles, for example steel articles, with zinc or cadmium. To further improve the corrosion resistance of zinc or cadmium plated metal articles, it is also well known to coat the plated article with one kind of chromium solution to provide a clear chromate coating. Although corrosion resistance is increased by such a clear chromate coating, corrosion resistance can be more significantly improved by coating with another kind of chromium solution to provide a yellow or olive-drab chromate coating. The resultant yellow or olive-drab colour can be returned to an acceptable white to grey colour by immersing the article in a sodium hydroxide or a sodium carbonate solution. Although this procedure slightly lessens the corrosion resistance, the final corrosion resistance is still superior to coating with clear chromate solution.

However, such known techniques do not provide as much corrosion resistance as is desired in some industries. For example, in the automobile industry, it is usual to store new vehicles on open lots exposed to the atmosphere for a considerable period of time prior to sale to a customer. The corrosion resistance of various parts of the vehicle should therefore be sufficient that substantially no corrosion can be perceived by a potential purchaser of a new vehicle. In the standard salt spray test of measuring the number of hours before corrosion of a protected article by salt spray has reached the base metal, even the best of the known techniques described above (when using barrel plating) only usually give a corrosion resistance time of the order of 100 hours.

It is therefore an object of the invention to provide an improved process for increasing the corrosion resistance of zinc or cadmium plated metal articles.

The present invention is based on the discovery that the corrosion resistance of a zinc or cadmium plated metal article coated with a chromate coating providing the article with a yellow to olive-drab colour can be dramatically improved by immersing the chromated article in a silicate solution for a sufficient time to cause the article to assume an acceptable white to grey colour i.e. leach back to a white to grey colour. Such treatment may for example give a corrosion resistance time in the above mentioned salt spray test of the order of 700 hours. It is not understood why this yellow or olive-drab chromate/silicate coating combination gives such improved corrosion resistance in addition to giving the article an acceptable white to grey colour.

The present invention is all the more surprising because applicant had in the past experimented with immersing a zinc plated metal article (both without any chromate coating and with a clear chromate coating) in a silicate solution. Although corrosion resistance was somewhat improved, the magnitude of the improvement was not such as to cause such a technique to be preferred over other known techniques. Similar comments apply to the process described in U.S. Pat. No. 4,367,099 (Lash et al) in which a plated article is treated with an aqueous acidic solution containing chromium ions substantially all of which are in the trivalent state, an oxidising agent and at least one additional metal ion selected from a specified group to form a passivate film, namely a clear chromate coating, and thereafter rinsing with a silicate solution.

As indicated above, it appears that success of the present invention resides in the combined use of a yellow or olive-drab chromate coating and silicate solution, such combined use producing a completely unexpected result, namely a dramatic improvement in corrosion resistance, as well as an acceptable colour. It has also been found that the present invention is especially cost-effective compared to known techniques.

In carrying out the invention, metal articles (which may for example be steel stampings, nuts, bolts or washers) are electroplated with zinc or cadmium in a conventional manner, for example by barrel plating or rack plating, preferably to a plating thickness of at least about 0.0003 inch (8 um). If necessary, hydrogen deembrittlement should be carried out immediately after plating at a temperature of at least about 400° F. (200° C.) for at least about 4 hours on 0.0003 inch (8 um) plating and at least about 8 hours for 0.0005 inch (13 um) plating.

The zinc or cadmium plated articles in the barrel or on the rack, are then dipped in a chromium solution containing a substantial amount of hexavalent chromium ions for preferably from about 15 to about 120 seconds at a temperature of preferably from about 70° F. to about 90° F. until a uniform yellow to olive-drab colouration is achieved all over the plated article. The concentration of the chromium solution is preferably from about 0.5 to about 2% by volume. The chromated articles are then rinsed in cold running water.

The chromated articles, in the barrel or on the rack, are then immersed in a silicate solution, preferably an alkali metal silicate solution such as sodium or potassium silicate solution with a concentration of from about 1 to about 50% by volume, preferably about 20%. The temperature of the silicate solution should preferably be in the range of from about ambient to about 200° F. (95° C.), more preferably around 100° F. (40° C.). The article should be immersed in the silicate solution until all the yellow or olive-drab colouration has been removed and the article has assumed an acceptable white to grey colour. This time will typically be of the order of 60 seconds. The article should then be dried in a suitable manner without rinsing.

Comparative tests were carried out by applying various known corrosion resistance techniques and treatment in accordance with the present invention to zinc plated metal articles, the thickness of the zinc plating being 0.0003 inches, and the various operations being carried out with the articles in a barrel rather than on a rack. A standard salt spray test was given to each article, and the minimum time to first corrosion of zinc and the minimum time to first corrosion of base metal was observed. The results are shown in the following Table.

TABLE 1

| | SALT SPRAY RESULTS | |
|---|---|---|
| PROCESS | Minimum hours to first corrosion of zinc | Minimum hours to corrosion of base |
| TRADITIONAL METHODS | | |

TABLE 1-continued

| PROCESS | SALT SPRAY RESULTS Minimum hours to first corrosion of zinc | Minimum hours to corrosion of base |
|---|---|---|
| Zinc as electroplated | Nil | 48 |
| Zinc and clear chromate coating | 16 | 72 |
| Zinc and yellow chromate coating | 48 | 96 |
| Zinc and olive-drab chromate coating | 96 | 120 |
| Zinc, yellow chromate coating and leach back to white with sodium hydroxide | 24 | 72 |
| Zinc and silicate coating | 24 | 72 |
| Zinc, clear chromate coating and silicate rinse | 36 | 96 |
| INVENTION | | |
| Zinc, yellow chromate coating and leach back to white with silicate | 120 | 700 |
| Zinc, olive-drab chromate coating and leach back to grey with silicate | 120 | 700 |

The dramatic improvement in corrosion resistance time obtained with the present invention compared to previously known corrosion resistant techniques is clearly evident from the results shown in the above Table. It has also been found that the results improve substantially if the various operations are carried out with the articles on a rack rather than in a barrel.

Other embodiments of the invention will be readily apparent to a person skilled in the art, the scope of the invention being defined in the appended claims.

What I claim as new and desire to protect by Letters Patent of the United States is:

1. A process for improving corrosion resistance of a metal article plated with zinc or cadmium, comprising coating the plated articles with a chromium solution to provide the article with a chromate coating having a yellow to olive-drab colour, and contacting the chromate coating witha silicate solution and maintaining said contact for a sufficient time to cause the colour of the coating to be leached back to an acceptable white to grey colour and also increase the corrosion resistance of the article.

2. A process according to claim 1 wherein the silicate solution is an alkali metal silicate solution.

3. A process according to claim 2 wherein the silicate solution is a sodium silicate solution with a concentration of from about 1 to about 50% by volume.

4. A process according to claim 1 wherein the silicate solution has a temperature of from about ambient to about 200° F. (95° C.).

5. A process for improving corrosion resistance of a metal article plated with zinc or cadmium, and with the zinc or cadmium plating being coated with a chromate coating providing the article with a yellow to olive-drab colour, the process comprising contacting the chromate coating with a silicate solution and maintaining said contact for a sufficient time to cause the colour of the coating to be leached back to an acceptable while to grey colour and also increase the corrosion resistance of the article.

6. A process according to claim 5 wherein the silicate solution is an alkali metal silicate solution.

7. A process according to claim 6 wherein the silicate solution is a sodium silicate solution with a concentration of from about 1 to about 50% by volume.

8. A process according to claim 5 wherein the silicate solution has a temperature of from about ambient to about 200° F. (95° C.).

* * * * *